United States Patent [19]

Gehring et al.

[11] 4,234,138

[45] Nov. 18, 1980

[54] THREAD GUIDE AT A WARP CREEL

[75] Inventors: Rudolf Gehring, Niederuzwil; Albert Brandenberger, Oberuzwil, both of Switzerland

[73] Assignee: Maschinenfabrik Beninger AG, Uzwil, Switzerland

[21] Appl. No.: 72,191

[22] Filed: Sep. 4, 1979

[30] Foreign Application Priority Data

Sep. 15, 1978 [CH] Switzerland ..... 9658/78

[51] Int. Cl.[3] ..... B65H 49/02; D02H 1/00

[52] U.S. Cl. ..... 242/131.1; 242/156.2

[58] Field of Search ..... 242/131, 131.1, 156 R, 242/156.2, 45; 28/36

[56] References Cited

U.S. PATENT DOCUMENTS

| | | | |
|---|---|---|---|
| 1,483,563 | 2/1924 | Wells | 242/131.1 |
| 3,371,878 | 3/1968 | Garner | 242/45 |

*Primary Examiner*—Leonard D. Christian

*Attorney, Agent, or Firm*—Werner W. Kleeman

[57] ABSTRACT

A thread guide for guiding a thread between a bobbin of a warp or bobbin creel, from which the thread is payed-off, through a thread tensioner, while deflecting the thread through about 90° in the direction towards a winding machine, is structured such that the thread, between its bobbin and upon leaving the creel, experiences a single deflection. This is accomplished by means of a deflection roll mounted to be low in friction and arranged at the outlet side of the thread from the bobbin creel. This deflection roll is arranged such that its axis extends vertically in a manner that the axis of the thread course, from the bobbin through the thread tensioner, up to the roll, forms a tangent at the traveling groove of the deflection roll. The deflection rolls which are operatively correlated with a vertical bobbin row at the creel are arranged in a tube or pipe. This tube consists of a number of tube sections, detachably interconnected with one another, while interposing in each case a deflection roll.

7 Claims, 3 Drawing Figures

THREAD GUIDE AT A WARP CREEL

BACKGROUND OF THE INVENTION

The present invention relates to a new and improved construction of a thread guide or thread guide arrangement at a warp or bobbin creel which is of the type having, for each thread, a thread tensioner and a deflection device in order to deflect the thread, during its exit from the creel, in the direction towards a winding machine.

With the classical arrangement of warping machines or beam warping machines, the axes of the bobbins which are mounted upon the creel, extend at least approximately in a plane which is parallel to the axis of the winding machine.

Such arrangement enables a random size selection of the creel in its lengthwise extent, and thus, it is possible to randomly select the number of bobbins. If the bobbins are arranged such that their axes are perpendicular to the axis of the winding machine, then with large number of bobbins the width extent of the creel would correspondingly increase. This, in turn, again would lead to the result that there would exist appreciable deviations of the angle through which the outer threads must be deflected in relation to the inner threads, in order to be able to be formed at the reed into a compact, parallel thread field.

However, such different deflections would render tremendously more difficult the production of and maintenance of as uniform as possible, and additionally, as low as possible tension of the threads of a thread field during winding upon the winding machine. Such is absolutely mandatory in order to produce a qualitatively faultless warp, since the thread tensioners of the outer threads must be differently adjusted, owing to their larger deflection, than those of the further inwardly situated threads and those of the innermost threads, experiencing practically no deflection.

These difficulties and sources of error are eliminated by the previously mentioned classical arrangement, because in such case all of these threads, upon exit out of the creel, are deflected approximately through 90°.

Yet, each deflection of a thread during warping or beaming is problematic for different reasons.

Firstly, the thread, due to its deflection between its infeed and outfeed, experiences an increase in tension due to the friction at the deflection device. This tension increase can be determined from cable friction principles and is dependent upon the construction of the deflection device, the material used for this purpose, and of course, also upon the thread quality. Furthermore, an additional factor which appreciably influences the friction, and thus, the thread tension, is that the contamination of the deflection device, which during operation of the system increasingly occurs, or even at that location where the thread always slides at the same location, as such is regularly the case at deflection devices in the form of deflection rods or thread guide eyelets, leads to possible wear of such locations.

Just the last-mentioned factors, influencing the friction behaviour at the deflection locations, are of course again different for each deflection location. Consequently, as to the threads of a creel, combined for instance into a warp section, there prevail within the warp section different tension conditions, negatively influencing the quality of the warped, and analogously, also a beamed warp.

Furthermore, when using eyelets or deflection rods for deflecting the threads, it is possible that with certain thread qualities, especially in the case of glass fibers or threads for instance, fibrillae dam-up during the deflection, and the threads are thus damaged by this phenomenon known as "fibrilla splitting".

SUMMARY OF THE INVENTION

Hence, with the foregoing in mind it is a primary object of the present invention to avoid the aforementioned drawbacks and to provide a new and improved construction of thread guide at the outlet side of the thread from a creel, which avoids damage to the thread and does not appreciably alter the tension set by the thread tensioner and, in any event, if it does then by the same amount for all of the threads, and avoids additional changes during the course of the textile processing operation and the thus resulting uncontrolled frictional losses.

Now in order to implement these and still further objects of the invention, which will become more readily apparent as the description proceeds, the thread guide or thread guide arrangement of the present development is manifested by the features that each thread, between the bobbin and upon leaving the warp creel, only experiences a single deflection. This deflection is accomplished by means of a standard roll which, by means of ball bearings, is mounted to be freely rotatable with its axis vertically extending at the outlet of the thread from the thread tensioner, and with the periphery of its thread travel groove being located in the axis of the thread course from the bobbin to the outlet from the thread tensioner.

The deflection of a thread, upon its departure out of the thread tensioner of a creel, by means of a deflection roll, is indeed known from German Pat. No. 814,858. However, with this thread guide as known from such patent, the thread, prior to its entry at the thread tensioner, is deflected by a deflection rod. Consequently, also with this construction all of the previously mentioned drawbacks arise due to the unpredictable and uncontrollable friction conditions.

Now with the inventive thread guide the different contaminant depositions and the cuts formed by wear of the material, cannot alter the friction conditions. Equally, the thread quality during rolling friction does not have any effect, in contrast to the conditions which arise during sliding friction, as such is the case during sliding of the thread at the deflection rods or eyelets. Only the bearing friction of the deflection rolls itself influences, with the inventive thread guide, the thread tension in addition to the thread tensioner. However, such can be maintained not only extremely small, but it additionally is at least approximately equal and constant for all threads and thus can be taken into account as a factor during the relevant setting of the thread tensioner.

A further advantage of the inventive thread guide resides in the appreciable reduction of the static charging of the thread, in contrast to non-rotating deflection devices, something which is extremely disturbing especially for certain thread qualities.

According to an advantageous constructional embodiment of the invention, all of the deflection rolls which are correlated in each case with a vertical bobbin row of the creel, are arranged at a deflection roll tube or pipe structure which is preferably detachably and adjustably secured at and parallel to the creel part which takes-up the thread tensioners of all bobbins and in each case forming a vertical row within the creel. Such deflection roll tubes can be easily pre-mounted and quickly and simply attached even at already existing creels.

Moreover, a particularly advantageous construction can reside in the fact that each deflection roll tube can be composed of tube sections, the length of which is accommodated to the spacing of two neighboring thread tensioners and which are provided at their ends with insert elements, by means of which the tube sections can be threadably connected with one another while clamping therebetween in each case one of the deflection rolls.

This allows for a particularly simple assembly of the deflection roll tubes and their accommodation to the most different types of creel models, while requiring few individual parts which must be maintained in storage.

The aforementioned insert elements all can be identical to one another and have a central hub possessing an axial threaded bore for the reception of a pin. This pin simultaneously serves as the connection pin for the interconnection of two tube sections and as the axle pin for a deflection roll. The insert elements further can have a peripheral collar which protrudes at the traveling or running surface of the roll.

The collar protruding at the travel or running surface of the deflection roll, in the presence of possible sliding away of a thread out of its roll, guides such thread upon itself or onto the deflection roll tube, and thus, prevents that the thread will undesirably move beneath the deflection roll and into the tube. At the collars of the insert elements there are advantageously provided openings in order that the difficulty accessible locations, at the region of the roll bearings, can be cleaned of contaminants by the action of compressed air or suction air.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, in order to illustrate the construction and mode of operation of the inventive suject matter there is assumed an arrangement for warping. The threads are payed-off a large number of bobbins or spools which have been mounted at a warping creel, after each individual thread has moved through a thread monitor or stop motion operatively associated therewith and a thread tensioner, the threads are then deflected in the direction of the warping machine, combined into a thread field and guided, through a leasing reed and a reed, in order to be wound in the form of a warp, with as uniform as possible tension, onto the winding drum of the warping machine. Throughout the various Figures of the accompanying drawings, there have only been shown those parts of the equipment together with the individual thread guides as the same are needed for understanding the underlying principles and concepts of the present invention.

Figure 1:
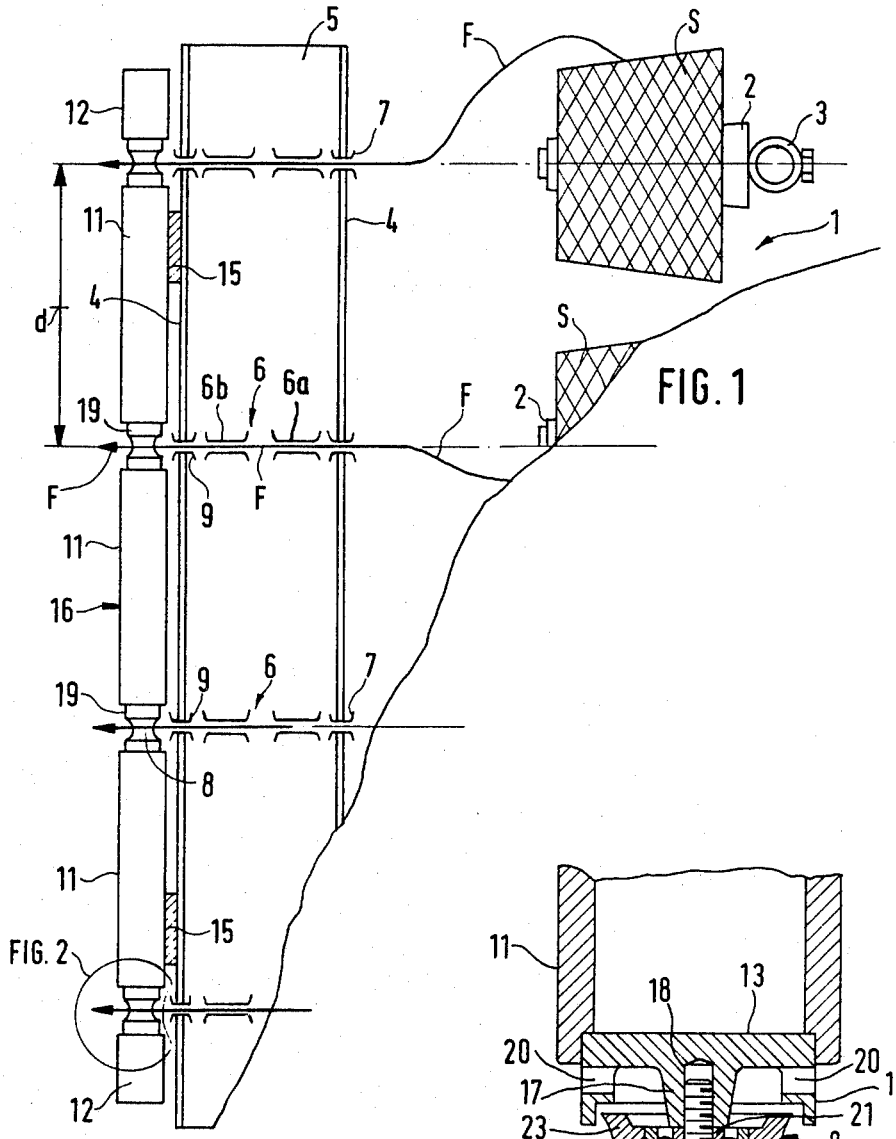
FIG. 1 is a schematic front view of part of a bobbin creel having a number of superimposed situated bobbins or spools and the related guides.

Now in the bobbin creel there are arranged a multiplicity of bobbins in known fashion within a bobbin frame in a narrow arrangement in horizontal levels or stages above one another. FIG. 1 shows two bobbins, each designated by reference character S, each of which belongs to a different level or stage.

The construction of the creeling devices 2 for the individual bobbins S can be assumed to be known in this technology. These creeling devices 2 of a creel level or stage are likewise secured in the bobbin creel, in known fashion at a uniform spacing from one another at the horizontal supports 3 and in their totality form, together with the supports or carriers 3 and the not particularly shown supports which support such carriers 3, the bobbin neck or panel 1 of the bobbin creel.

Figure 3:
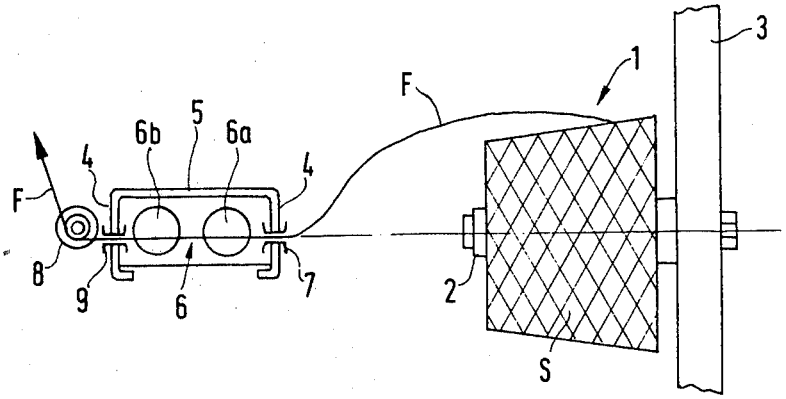
FIG. 3 is a schematic sectional illustration, in a horizontal plane, through a part of a bobbin creel installation with a bobbin and the related thread guide.

The thread F which is payed-off each bobbin S, is drawn through both of the legs or leg members 4 of a profile rail 5, of substantially U-shaped configuration in cross-section, which is located at the direct neighbourhood of its bobbin S (see FIG. 3).

In or at such rail 5 there are arranged all of the thread guides for the threads of those bobbins which, at the bobbin creel, form a vertical row. The totality of the rails 5 forms the brake rack of the bobbin creel.

After its departure out of the rail 5 each thread is deflected, in a manner still to be described, through about 90° in the direction towards a not particularly illustrated but standard winding drum of the warping machine.

Along the path between both of the legs or leg members 4 of the rail 5 the thread F linearly passes a thread tension device or thread tensioner 6 which is operatively associated therewith. Details of the construction of the thread tension device or thread tensioner 6 have not been shown since they are not important for understanding the principles of the invention, and moreover, any prior art thread tensioner or thread tension device, through which the thread is linearly guided, especially without any deflection, can be advantageously employed in practicing the invention. Thus, there has been simply schematically illustrated in the embodiment under discussion a plate brake, composed of two plate pairs *6a* and *6b*, as the same has been described and disclosed for instance in greater detail in Swiss Pat. No. 452,452, to which reference may be had and the disclosure of which is incorporated herein by reference. This particular thread tensioner or tension device has the advantage that, by virtue of the fact that the thread is guided linearly between both of the plate pairs *6a* and *6b*, there is beneficially brought about the cleaning of the plate surfaces themselves. Consequently, the contaminant particles which are removed, by the plate surfaces, from the thread, are continuously displaced towards the outer edge of the plates or towards the edge of a central opening in the plates and pass such.

As apparent from the showing of the drawings, the thread F at each bobbin S passes through a thread guide eyelet 7, arranged at an extension of the bobbin axis, through the leg 4 of the U-shaped rail 5 into its opening, passes in the aforementioned axis continuously the operatively associated thread tensioner or tensioning device 6, and then leaves the rail 5 by means of an exit or outlet eyelet 9 likewise arranged along the same axis. At the exit or outlet of the thread F from the rail 5 there must be accomplished the previously mentioned, approximately right-angled deflection of the thread F in the direction of the winding machine.

To that end, with the inventive thread guide there is provided a deflection roll 8, the arrangement and construction of which will be described more fully hereinafter.

Figure 2:
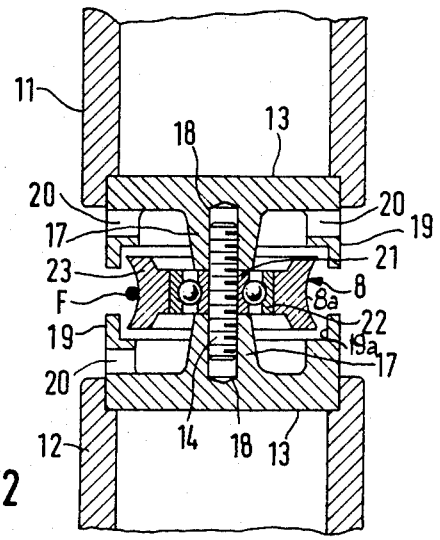
FIG. 2 is a vertical sectional view through the region of the bobbin creel shown in a circle at the lower left-hand portion of FIG. 1.

As particularly well seen from FIGS. 1 and 2, all of the deflection rolls 8, operatively associated with a vertical row of bobbins in the creel, are combined into a deflection roll tube or pipe, generally designated by reference character 16 in FIG. 1. This deflection roll tube or pipe 16 is advantageously detachably and adjustably secured, by means of conventional attachment means 15, at the outer leg 4 of the braking rack rail 5 and in parallelism therewith. Such deflection roll tube 16 consists of a number of tube sections 11 and, in each case, an upper end tubular piece and lower end tubular piece or section, each generally designated by reference character 12. At the end openings of the tube sections 11 and equally at the relevant end of the end tubular sections 12, there are mounted, as by being pressed thereon the insert elements 13, as best seen by referring to FIG. 2. All of the insert elements 13 are of identical construction and possess a hub 17 having a threaded bore 18 extending in the axis of the tubular section and a collar 19 having one or a number of contaminant openings 20.

The connection of the tubular sections 11 and the end tube elements or pieces 12 into a deflection roll tube 16 of desired length is accomplished by means of the threaded pins or screws 14 which are threaded into the threaded bores 18 of two oppositely situated insert elements or pieces 13. Mounted upon the threaded pins 14 is a respective ball bearing-mounted deflection roll 8. The inner race 21 of the ball bearing 21, 22 of the deflection roll 8 is fixedly clamped, upon tightening the connection pin or screw 14, between the end surfaces of both oppositely situated hubs 17, so that there is exactly fixed the position of the related deflection roll 8.

The jacket or outer surface 23 of the deflection roll 8, which is fixedly seated upon the outer race 22 of the ball bearing 21, 22, is formed in conventional fashion concavely to form a thread travel or running groove 8*a*. The external or outer ends of the travel surface or groove 8*a* of the deflection roll 8, viewed in cross-section, extend, as shown clearly from the illustration of FIG. 2, up to the region behind the inner surface 19*a* of the corresponding collar 19 of the neighbouring insert elements 13. This arrangement prevents a thread F, travelling over the roll 8, in the event of any possible sliding out of such thread from the roll 8, from arriving below or above such roll 8 at the region of the bearings 21, 22 and becoming caught at such location. A thread F which jumps off of the deflection roll 8 is thus rendered extremely visible or accessible at the collar 19 or can even travel onto a deflection roll tube part or section 11 or 12.

The contaminant openings 20, provided at the insert pieces or elements 13, render possible cleaning by exerting a blowing action at contaminants which have particularly collected at the region of the insert element 13 located below a roll 8.

Of course, the length of the tube section 11 is dimensioned such that the spacing d of the deflection rolls 8 from one another coincides exactly with the vertical spacing of the thread tension devices or tensioners 6 mounted at the brake rail 5.

From what has been discussed above it will be apparent that the construction of the deflection roll tube 16, needed for a certain creel, can be accomplished very simply, and that for the most different creels and also for the post-equipping of already existing creels with the inventive thread guides, there are required only relatively few parts which must be stored. In particular, such are the tubes from which there are cut the sections 11 and end pieces 12 in the requisite length, as well as the insert elements 13, the rolls 8 and the threaded pins 14. With these basic elements it is possible to threadably interconnect, starting from one end, the deflection roll tube 16 in the desired length and with the requisite pitch or division of the roll spacing from one end.

The attachment of the deflection roll tube 16, which is pre-assembled in this manner, at the outer legs 4 of the rail 5, by means of the attachments or attachment means 15, is then accomplished in a manner that the travel grooves 8*a* of the rolls 8 come to lie with their periphery, on the one hand, exactly at the height of the exit of the thread out of the related thread tensioner 6 and, on the other hand, at the axis of the thread travel from the related bobbin through the thread tensioner until its exit out of the thread tensioner. In this way there is ensured that each payed-off thread experiences only a single deflection between its bobbin and the reed of the winder machine and this single deflection is accomplished optimumly low in friction by means of a freely rotatable mounted deflection roll.

It should be understood that the described thread guide or thread guide arrangement, when processing extremely delicate fiber material, especially glass fiber threads or yarns and the like, but also with coarser titers, is particularly advantageous. This is so in the first-mentioned case due to its sensitivity to deflections (fibrillae splitting); in the last-mentioned case owing to its tendency at friction locations to react particularly strongly in the sense of increasing the thread tension.

Furthermore, it has been found during tests with the inventive thread guide that there were unfounded the fears that a further rotation or idling of the deflection rolls, with sudden stoppage of the winding installations, could have a disadvantageous effect. It is in fact readily possible for the deflection roll, with sudden standstill of the thread which travels thereabout, to still rotate somewhat, but the thread, on the other hand, is not further payed-off, both because of its low wrappage about the deflection roll and due to the deflection. During such tests it also could be determined that, when working in the thread field between the creel and the winding machine or upon loosening of the threads, such, to the extent that the same even slid out of the thread traveling or travel groove of their deflection roll, arrived at the periphery of the collar of the insert element or the deflection roll tube 11 and, in the majority of cases, when restarting operation of the system, these threads themselves tended to return back into the traveling groove of their deflection roll.

In the illustrated exemplary embodiment the deflection roll tube 16 is arranged at a creel of conventional construction, wherein the threads are deflected, at the thread eyelets 9, at their outlet from the rail 5.

With the inventive thread guide or thread guide arrangement it is therefore possible to dispense with the use of the previous task of the thread eyelets 9. Such can be completely omitted when dealing with a new construction of bobbin creel, or, in any event, formed of less expensive material, when an existing bobbin creel is to be modified to incorporate the structure of the invention, since the threads payed-off from the bobbin creel, during normal travel, no longer come into contact with such eyelets.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A thread guide arrangement at a bobbin creel comprising, in combination:

a thread tensioning device through which there is essentially linearly guided a thread which is payed-off of a bobbin;

an individual deflection device for deflecting each thread, upon its exit from the creel, in the direction of a winding machine;

said deflection device imparting to the thread only a single deflection during its movement between the bobbin and upon leaving the creel;

each said deflection device comprising a deflection roll having a lengthwise axis and by means of which there is accomplished said deflection;

bearing means for mounting said deflection roll so as to be freely rotatable with its lengthwise axis extending essentially vertically; and said deflection roll having a travel groove, the periphery of said travel groove being arranged substantially along the axis of the thread travel from the bobbin until departure from the thread tensioning device and located at the outlet side of the thread from the thread tensioning device.

2. The thread guide arrangement as defined in claim 1, further including:

deflection roll tube means provided for said deflection rolls;

all of said deflection rolls operatively associated with a vertical bobbin row of the creel being arranged at said deflection roll tube means;

means for attaching said deflection roll tube means at a part of the creel;

said creel part serving to house the thread tensioning devices for the threads of all of the bobbins which form a vertical row in the creel.

3. The thread guide arrangement as defined in claim 2, wherein:

said attachment means detachably and adjustably secure said deflection roll tube means at said creel part and essentially parallel thereto.

4. A thread guide arrangement at a bobbin creel comprising, in combination:

a thread tensioning device through which there is essentially linearly guided a thread which is payed-off of a bobbin;

a deflection device for deflecting the thread, upon its exit from the creel, in the direction of a winding machine;

said deflection device imparting to the thread only a single deflection during its movement between the bobbin and upon leaving the creel;

said deflection device comprising a deflection roll having a lengthwise axis and by means of which there is accomplished said deflection;

bearing means for mounting said deflection roll so as to be freely rotatable with its lengthwise axis extending essentially vertically;

said deflection roll having a travel groove, the periphery of said travel groove being arranged substantially along the axis of the thread travel from the bobbin until departure from the thread tensioning device and located at the outlet side of the thread from the thread tensioning device;

said deflection device comprises a plurality of said deflection rolls;

deflection roll tube means provided for said deflection rolls;

all of said deflection rolls operatively associated with a vertical bobbin row of the creel being arranged at a deflection roll tube means;

means for attaching said deflection roll tube means at a part of the creel;

said creel part serving to house the thread tensioning devices for the threads of all of the bobbins which form a vertical row in the creel;

each deflection roll tube means comprises tube sections, the length of which is accommodated to the spacing of two neighboring thread tensioning devices; and said tube sections being provided at their ends with insert elements by means of which the tube sections can be connected to one another while clamping therebetween a respective deflection roll.

5. The thread guide arrangement as defined in claim 4, wherein:

said insert elements are of essentially identical construction and each have a substantially central hub possessing an axial threaded bore for receiving a connection pin;

a connection pin engaging with said central hubs of two confronting insert elements and constituting both the connection between two tube sections and an axle pin for a deflection roll; and a peripheral collar means protruding past part of the travel groove of the deflection roll.

6. The thread guide arrangement as defined in claim 5, wherein:

ball bearing-mounted rolls serve as the deflection rolls; and the end surfaces of the hubs of the confronting insert elements being positionable and fixable between two neighboring tube sections by means of an inner race of the ball bearing of the related deflection roll.

7. The thread guide arrangement as defined in claim 6, wherein:

the insert elements are provided with opening means at the collar means for removal of contaminants by the action of an air stream.

* * * * *